US007614255B2

(12) United States Patent
Hagens et al.

(10) Patent No.: US 7,614,255 B2
(45) Date of Patent: Nov. 10, 2009

(54) CUTTING NEEDLE

(75) Inventors: Bob Hagens, Denver, NC (US); Uwe Stingel, Messtetten (DE); Eckhard Fehrenbacher, Bondorf (DE)

(73) Assignee: Groz-Beckert KG, Albstadt (DE)

( * ) Notice: Subject to any disclaimer, the term of this patent is extended or adjusted under 35 U.S.C. 154(b) by 583 days.

(21) Appl. No.: 11/099,681

(22) Filed: Apr. 6, 2005

(65) Prior Publication Data

US 2006/0236726 A1 Oct. 26, 2006

(51) Int. Cl.
*D04B 35/04* (2006.01)

(52) U.S. Cl. ..... 66/123; 66/121

(58) Field of Classification Search ..... 66/121, 66/123, 116, 120, 178 R, 179–185
See application file for complete search history.

(56) References Cited

U.S. PATENT DOCUMENTS 1,120,989 A 12/1914 Williams
2,335,075 A * 11/1943 Needham ..... 66/8
3,040,551 A 6/1962 Urlaub
4,026,126 A * 5/1977 Nuber ..... 66/9 R
4,089,192 A * 5/1978 Kohorn ..... 66/123
4,537,048 A * 8/1985 Gutschmit et al. ..... 66/93
6,298,693 B1 * 10/2001 Schaffer ..... 66/123
6,612,135 B1 * 9/2003 Pinzauti ..... 66/93
6,807,831 B2 * 10/2004 Roth ..... 66/123
2003/0233853 A1 12/2003 Roth

FOREIGN PATENT DOCUMENTS

DE 102 27 5331 C1 12/2003
GB 2 062 696 A 5/1981

* cited by examiner

*Primary Examiner*—Danny Worrell
(74) *Attorney, Agent, or Firm*—Fitch, Even, Tabin & Flannery; Norman N. Kunitz

(57) ABSTRACT

The cutting needle (1) according to the invention is, for example, a latch needle and has a knife element (11) secured to the shank (2). The knife element (11) defines a cutting edge (18) which projects obliquely upward from the shank. The knife element (11) is arranged externally of the range of motion of the latch (4) and cuts open a loop situated on the shank when it is overdriven outward. The knife element (11) is made, for example, of a suitable spring steel and is held unremovably on the shank (2).

7 Claims, 8 Drawing Sheets

CUTTING NEEDLE

FIELD OF THE INVENTION

The invention relates to a cutting needle for loop-forming textile machines. The invention relates in particular to a cutting needle for the manufacture of plush and velour products, but particularly for making Jacquard-velour-plush patterns, as well as to a cutting needle for severing threads of a product on a flat knitting machine.

BACKGROUND OF THE INVENTION

In the manufacture of cut-pile velours on knitting machines, the plush tucks tensioned in a loop-like manner are cut open by suitable cutting tools directly on the machine. In this connection reference is made to German Patent No. 11 53 482 which discloses a circular knitting machine for the manufacture of plush products. The machine includes a dial provided with guide grooves into which plush sinkers are inserted. The plush thread, guided by latch needles of the needle cylinder, is knocked over and looped by the plush sinkers. Each plush sinker has a cutting portion provided with an inward-directed cutting edge which cooperates in a scissors-like manner with an outward-directed cutting edge of a stationary cutting sinker.

Aside from the manufacture of cut-pile velours, in loop-forming textile machines the need occasionally also arises for other reasons to sever individual threads during the knitting process. In this connection reference is made to German Offenlegungsschrift (application published without examination) No. 20 03 301 which describes a circular knitting machine for stockings. The circular knitting machine operates with cutting needles which are inserted into the needle grooves of the needle cylinder. The cutting needles are formed as latch needles which have on their shank a ground, razor-sharp cutting edge oriented at an inclination to the longitudinal direction of the shank. As the needles move out into their cutting position, the cutting edge severs the loop suspended from the shank.

Cutting needles without a device for closing the hook, such as latches or the like, are described in German Patent No. 44 02 707 C2. At a shank location spaced from the hook, the cutting needle is provided with a cutting edge oriented at an inclination to the longitudinal direction of the shank. The cutting edge is ground to a wavy shape which increases the service life of the cutting needle.

The service life of the cutting needle is determined by its cutting edge. It is, accordingly, the object of the invention to further improve the cutting edge.

SUMMARY OF THE INVENTION

The object is achieved by the inventive cutting needle for loop-forming textile machines.

The cutting needle according to the invention is at least a two-part structure, that is, it has a shank and a knife element provided thereon. The knife element is separately made and is connected to the shank preferably unremovably, for example, by welding, swaging, riveting, gluing or by any other suitable connecting means. If required, however, the knife element may be removably coupled with the shank.

The knife element is preferably made of a material which is different from that of the shank. Consequently, the knife element may be made of a material selected on the basis of its cutting properties, whereas the shank or the cutting needle itself may be selected from a material on the basis of other criteria. In this manner the service life of the cutting needle may be extended.

The cutting needle according to the invention may find application in Jacquard cut-pile velour machines, flat knitting machines and circular knitting machines, each having at least two rows of knitting heads. The cutting needle then serves for cutting open the loops and for accurately cutting off the thread ends. The thread ends remaining on the knitted fabric may be cut practically as short as desired. In the manufacture of the needle a stamping tool may find application which is used for making a usual latch needle or transfer needle. For example, a special knife element may be mounted on the needle in a manner known in the use of transfer springs.

The knife element is preferably a spring element having at least one sharpened edge, that is, an edge constituting a cutting edge. The spring element may be entirely planar, in which case it does not function as a transfer spring. Preferably, however, the knife element lies resiliently on the side face of the shank; in this manner it may follow a lateral thread path to a certain extent. The cutting edge is movable at least to a slight extent relative to the shank. In this manner an abrasion effect of the thread on the cutting edge may be significantly limited, and a long service life may be achieved. As concerns the lateral mobility of the cutting element, it is particularly advantageous to connect the knife element with the shank only at an end, preferably at the end remote from the hook.

It is also feasible to make the knife element non-planar, for example, to offset it laterally, so that the knife element may also be used as a transfer spring. In such a case the knife element has a cutting portion carrying the cutting edge and a transfer portion which extends at a certain distance from the shank as a box spring and defines a penetration space for another needle. A loop support is provided for a defined positioning of the loop during the transfer step. In conventional needles the loop support is formed by a shoulder of the needle body. The loop support in the needle according to the invention, in contrast, may be formed on the knife element, in which case the loop support is a functional part of the knife element. Such a part is configured and arranged so that dependent on the progress of the penetration of the transfer needle during transfer or during cutting, either the transfer function or the cutting function is performed. It is thus feasible to make cut-pile velours or a cut-pile velour Jacquard pattern with the knitting machine with or without a transfer step. In case of knife elements too, which are configured as transfer springs, the advantage of accurately severing the threads or cutting open the loops is preserved.

The cutting edge formed on the knife element is situated preferably above the shank and it extends preferably at an inclination to the longitudinal direction of the shank. The cutting edge may be a ground knife edge. If required, the cutting edge may be ground to a wavy shape. These measures ensure that the loops are accurately cut open, while leaving behind only extremely short thread ends. Further, a long service life is obtained.

It is feasible to provide a cutting edge which is arcuate or which has an arcuate portion. Such a construction provides for a high degree of operational reliability.

Further details of advantageous embodiments of the invention may be found in the drawing, the specification or the dependent claims

BRIEF DESCRIPTION OF THE DRAWINGS

In the drawing, which illustrates various embodiments of the invention.

DETAILED DESCRIPTION OF THE INVENTION

Figure 1:
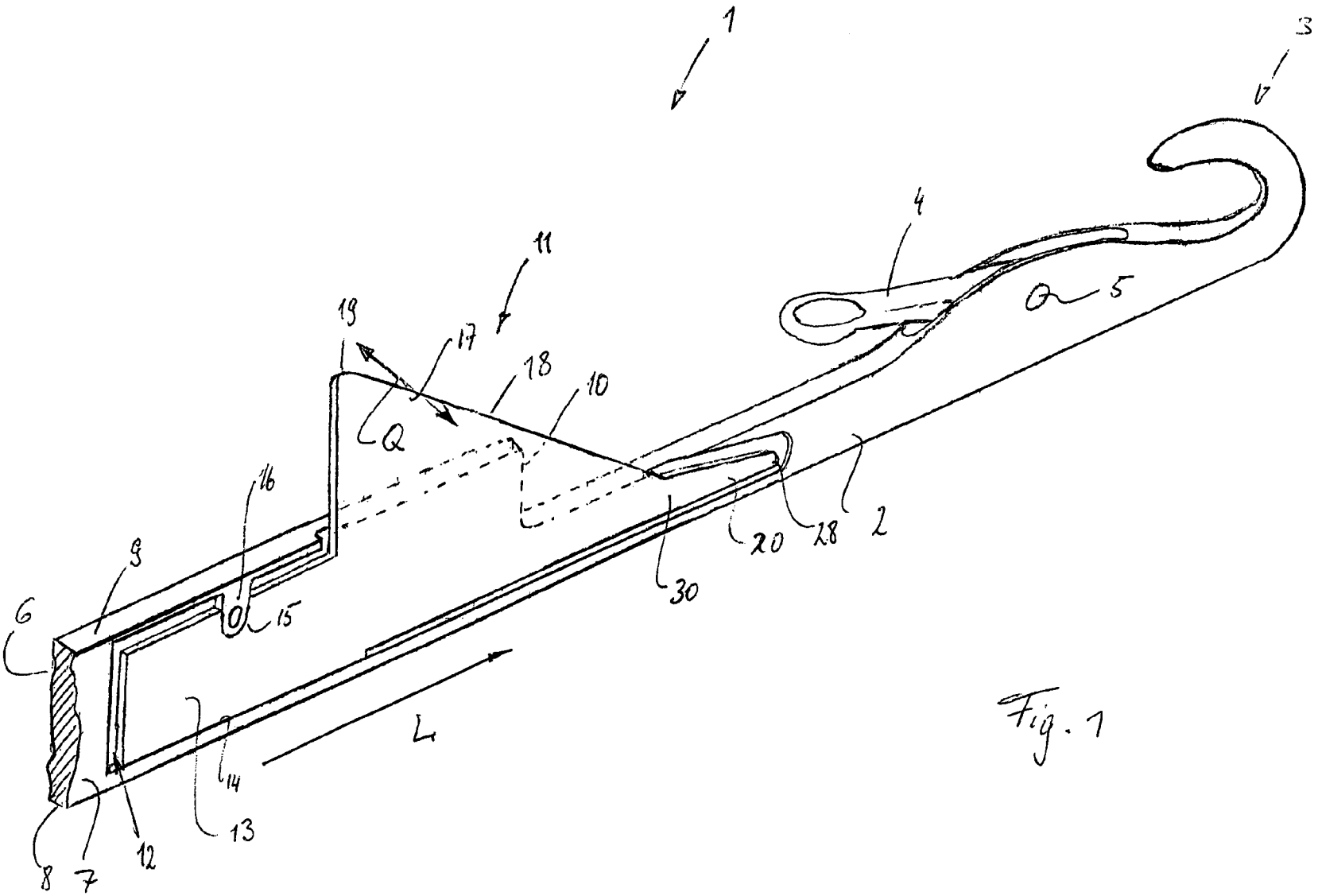
FIG. 1 is a perspective basic view of the cutting needle according to the invention.

FIG. 1 illustrates a cutting needle 1 which is utilized preferably in knitting machines, that is, in knitting systems, as part of a loop-forming system for making knitted products. The cutting needle 1 has a shank 2 having an end on which a hook 3 is formed. The cutting needle 1 is configured as a latch needle which, accordingly, has a latch 4 pivotally supported for back and forth movement on the shank 2 by a pivot 5 for closing or opening the hook 3. The latch may be freely pivotally held and is moved by the thread itself and/or by suitable actuating means, such as brushes or the like. With the latch 4 a non-illustrated latch spring may be associated for stabilizing the latch 4 in its closed or in its reversed position. It is further feasible to configure the cutting needle 1 as a compound needle. In such a case, instead of the latch 4 a slider (not shown) is provided which is parallel to the shank 2 and which is longitudinally slidable for opening or closing the hook 3.

As shown schematically in FIG. 1, the shank 2 is of elongate structure and has preferably a rectangular cross section. Along its schematically indicated longitudinal direction L the shank 2 has a thickness measured between its two flat sides 6, 7. The shank height, measured between the needle back 8 and the upper needle side 9, may vary; it may be provided, for example, with one or more steps 10.

At that end of the shank 2 which is remote from the hook 3 or at another suitable location, the shank 2 is provided with a butt projecting upward and perpendicularly from the upper needle side 9. The butt serves for driving the cutting needle 1, that is, for moving it in its longitudinal direction L. For producing the knitted fabric, the cutting needle is moved back and forth in the needle groove of a needle bed in the longitudinal direction L.

To the shank 2 of the cutting needle 1 a knife element 11 is secured which serves for cutting open loops which are situated in a proper position on the shank 2. The knife element 11 according to the embodiment of FIG. 1 is a planar, thin sheet metal spring, whose thickness is less than that of the shank 2. For receiving the knife element 11, in one flat side 7 of the shank 2 a recess 12 is provided, whose depth is slightly greater than, or is equal to, the thickness of the knife element 11.

The knife element 11 is made, for example, of a suitable spring steel and is unremovably attached to the shank 2. For this purpose, the knife element 11 has, as viewed from the side, an approximately rectangular mounting portion 13 which is held in the recess 12 with a slight play or with no play at all. For example, the lower edge 14 of the mounting portion 13, that is, the edge oriented toward the needle back 8, lies against the edge of the recess 12. On the opposite side the mounting portion 13 may be provided with a notch-like recess 15, into which extends a projection 16 oriented toward the edge 14. The projection 16 may function as a rivet and may be deformed with a suitable riveting tool or a laser beam in such a manner that it holds the mounting portion 13 captive in the recess 12.

In the alternative, it is feasible to simply insert the knife element into the recess 12, so that it is held in the longitudinal direction L in a form-locking manner by the recess 15 and the projection 16, but is laterally removable. Accordingly, the knife element is held captive on the cutting needle 1 as long as the latter is positioned in the needle groove of a needle bed.

The projection 16 may be a rivet-like securing device, that is, the knife element may swaged with the shank 2. Other means, however, may be chosen for securing the knife element 11 to the shank 2. For example, the securing portion 13 may be connected with the shank 2 by individual weld dots or weld seams, effected, for example, by a laser welding process. It is further feasible to glue the knife element 11 to the shank 2 at certain locations or over a full surface. Alternative welding processes, such as ultrasonic welding processes, frictional welding processes, resistance welding processes, soldering processes or the like may also be used.

In the alternative, in accordance with German Patent No. 102 27 533, the knife element may be received in a narrow slot which is oriented parallel or at an acute angle to the flat sides 6, 7. The securing portion 13 of the knife element 11 is held in the slot form-fittingly and/or by friction and/or by bonding with an interposed material.

The knife element 11 has a cutting portion 17 which projects beyond the upper needle side 9 and which, for example, forms a ramp with an upward inclination away from the hook 3. Consequently, the cutting portion 17 is triangular as viewed from the side. The cutting portion 17 has a sharply ground cutting edge 18 which, for example, begins immediately at the shank 2 and extends up to an upper corner 19. Below the cutting edge 18 on the knife element an extension 20 may be provided which projects toward the hook 3 and which is situated within that end of the recess 12 that is adjacent the hook 3. The extension 20 may be structured such that its end 28 oriented toward the hook 3 is situated completely in the recess 12, while its end 30 oriented away from the hook 3 slightly projects from the recess. The thickness of the extension 20, measured transversely to the longitudinal direction L of the shank 2 of the cutting needle 1 thus continuously increases from its end 28 toward its end 30. By virtue of this construction, the extension 20 may assist in a sliding of the loops, held on the shank 2, up the ramp when the loops are to be cut open. The knife element may, due to its resilience, execute a slight lateral motion which is transverse to the longitudinal direction L. Such transverse direction is designated at Q in FIG. 1 and applies to the other Figures and embodiments as well.

Figure 2:
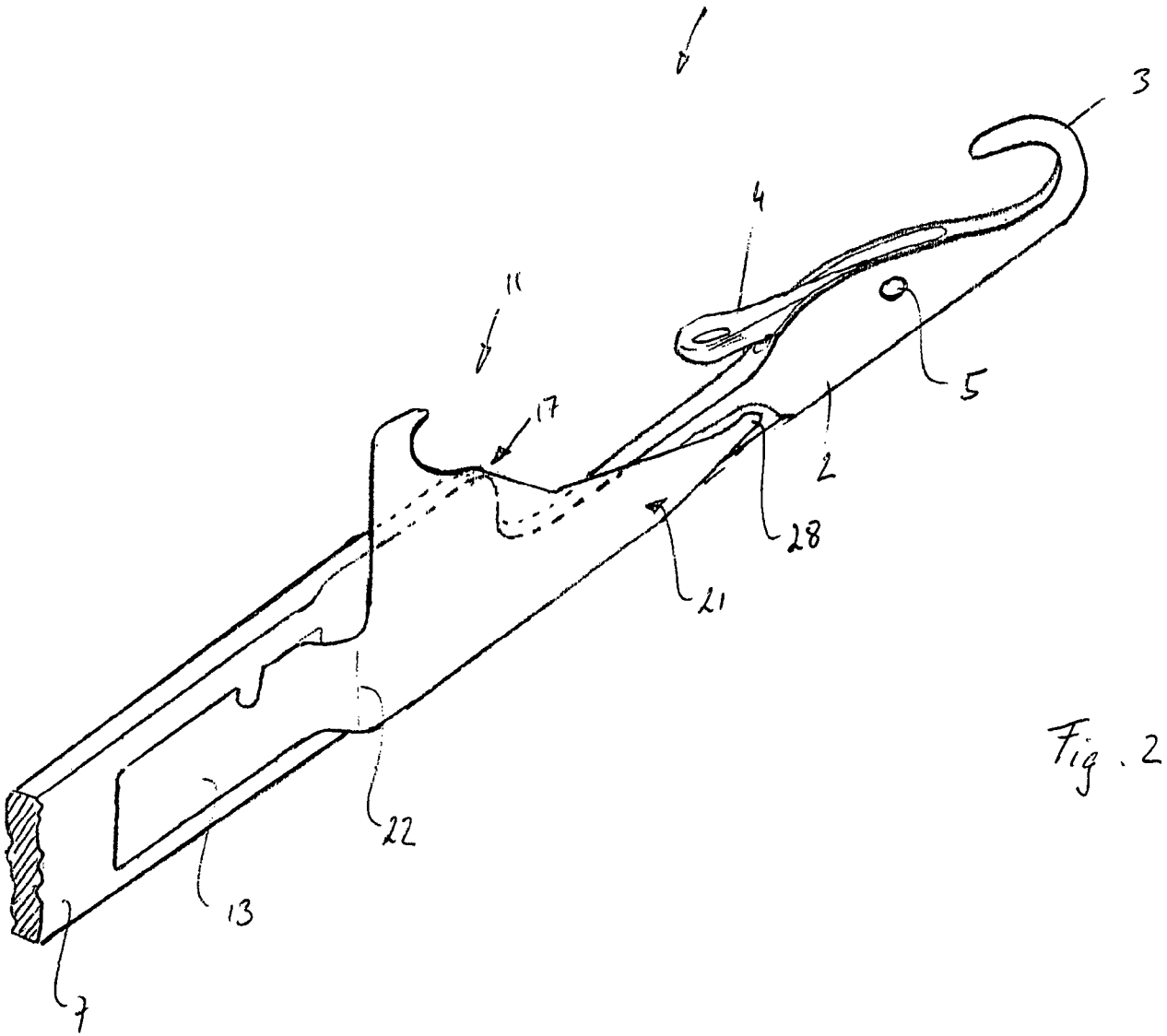
FIG. 2 is a perspective basic view of a modified embodiment of the cutting needle.

FIG. 2 shows a modified embodiment of the cutting needle 1. To the extent that such a modified embodiment corresponds to the earlier described cutting needle 1, reference is made to the preceding description, while using the same reference characters.

Figure 3:
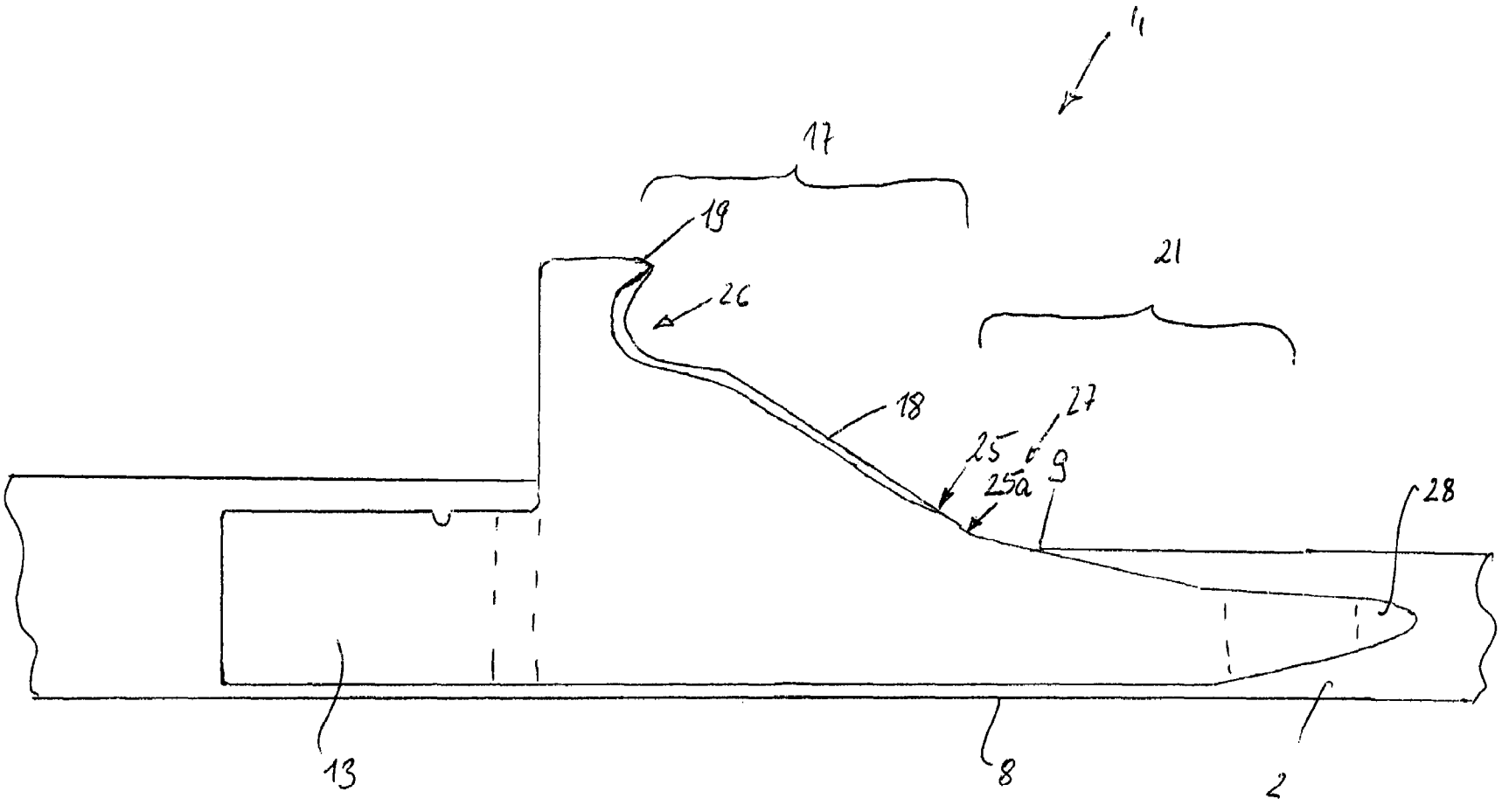
FIG. 3 is a fragmentary side elevational view of the cutting needle according to FIG. 2.
Figure 6:
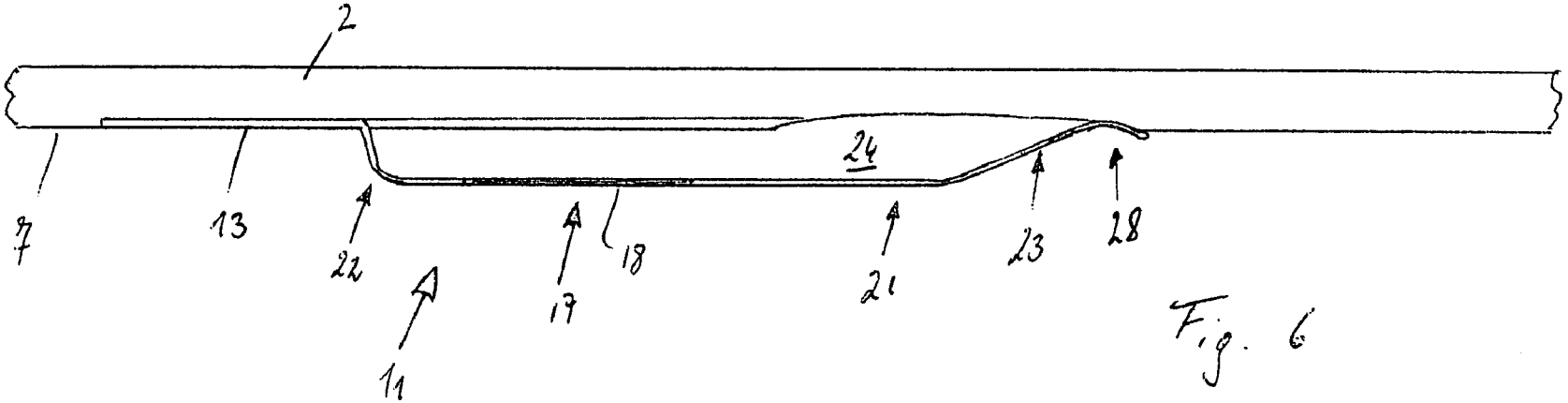
FIG. 6 is a fragmentary top plan view of the cutting needle according to FIG. 2, 3, 4 or 5.

The cutting needle 1 according to FIG. 2 performs a transfer function. The knife element 11 is shaped as a transfer needle and accordingly has a cutting portion 17 as well as a transfer portion 21 as it is also shown in FIG. 3. Again, the knife element 11 is held on the shank 2 by means of its securing portion 13. As shown in FIG. 6, at the end of the securing portion 13 the knife element 11 is bent away from the shank 2. At a location of bend 22 the knife element 11 changes into a plane which is oriented parallel to the flat side 7 and in which extend both the cutting portion 17 with its cutting edge 18 and the transfer portion 21. The end region 23 of the knife element 11 oriented toward the hook 3 is bent toward the shank 2 and engages it resiliently. In this manner the knife element 11 constitutes simultaneously a transfer spring with a free penetration space 24 into which cooperating needles may penetrate for taking off uncut loops from the knife element 11 or, more precisely, from its transfer portion 21. Accordingly, the cutting edge 18, as seen in particular in FIG. 3, occupies only one part of the length of the knife element 11. The hook-side end 25 of the cutting edge 18 marks the beginning of the transfer portion 21 and is located on the upper edge of the knife element 11, slightly above the upper needle side 9. Particularly in the region of the transfer portion 21 the edges of the knife element 11 are rounded in such a manner that they have no cutting properties. This applies particularly also to an edge portion 25*a* which is formed on the knife element 11 above the upper needle side 9 and which leads to the end 25. The edge portion 25*a* functions as a loop support 27. A loop situated on the shank may run up onto the loop support 27 and is positioned there to be taken over by a penetrating needle.

Figure 4:
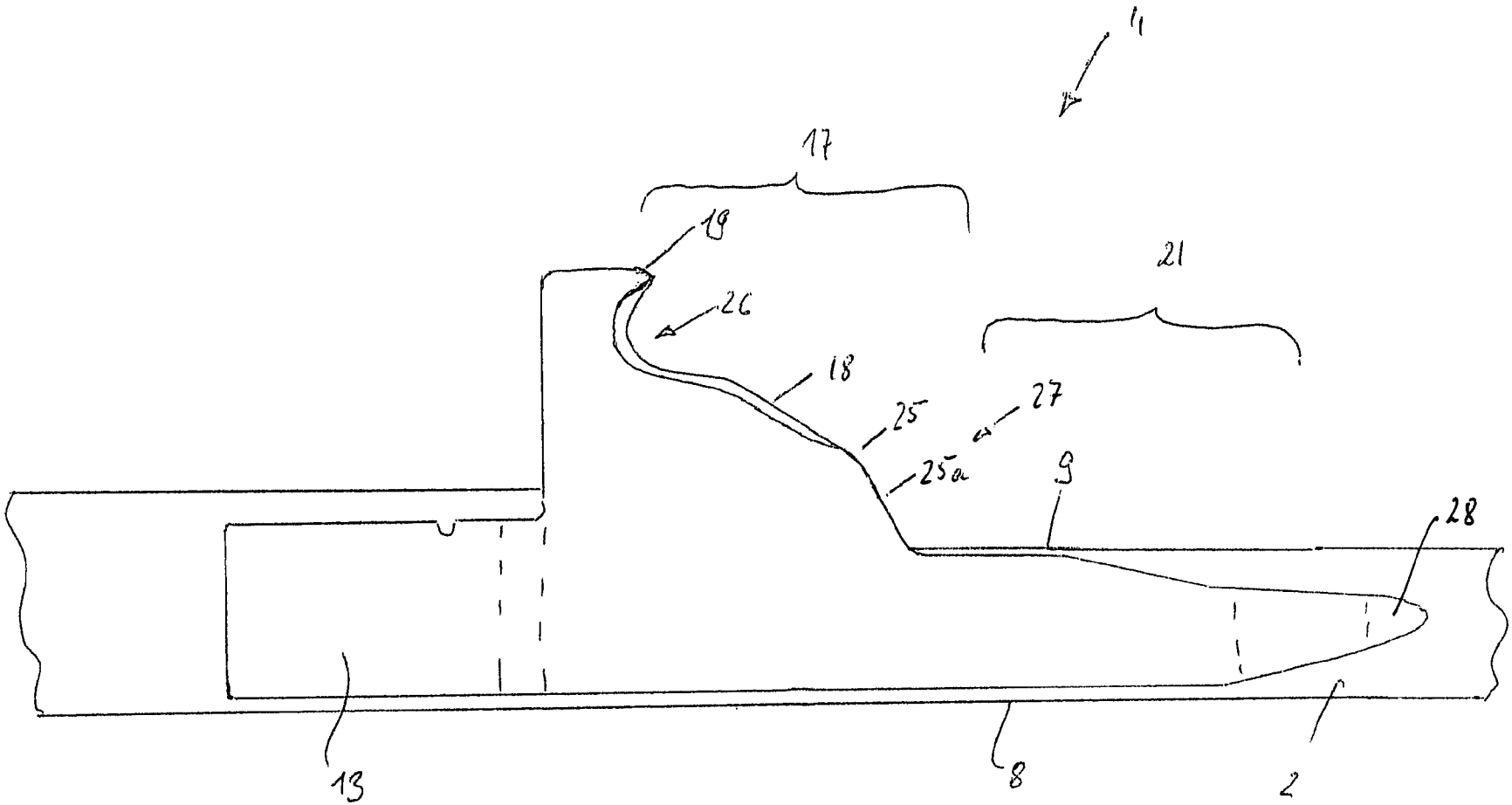
FIG. 4 is a side elevational view of a modified embodiment of the cutting needle similar to FIG. 2.
Figure 5:
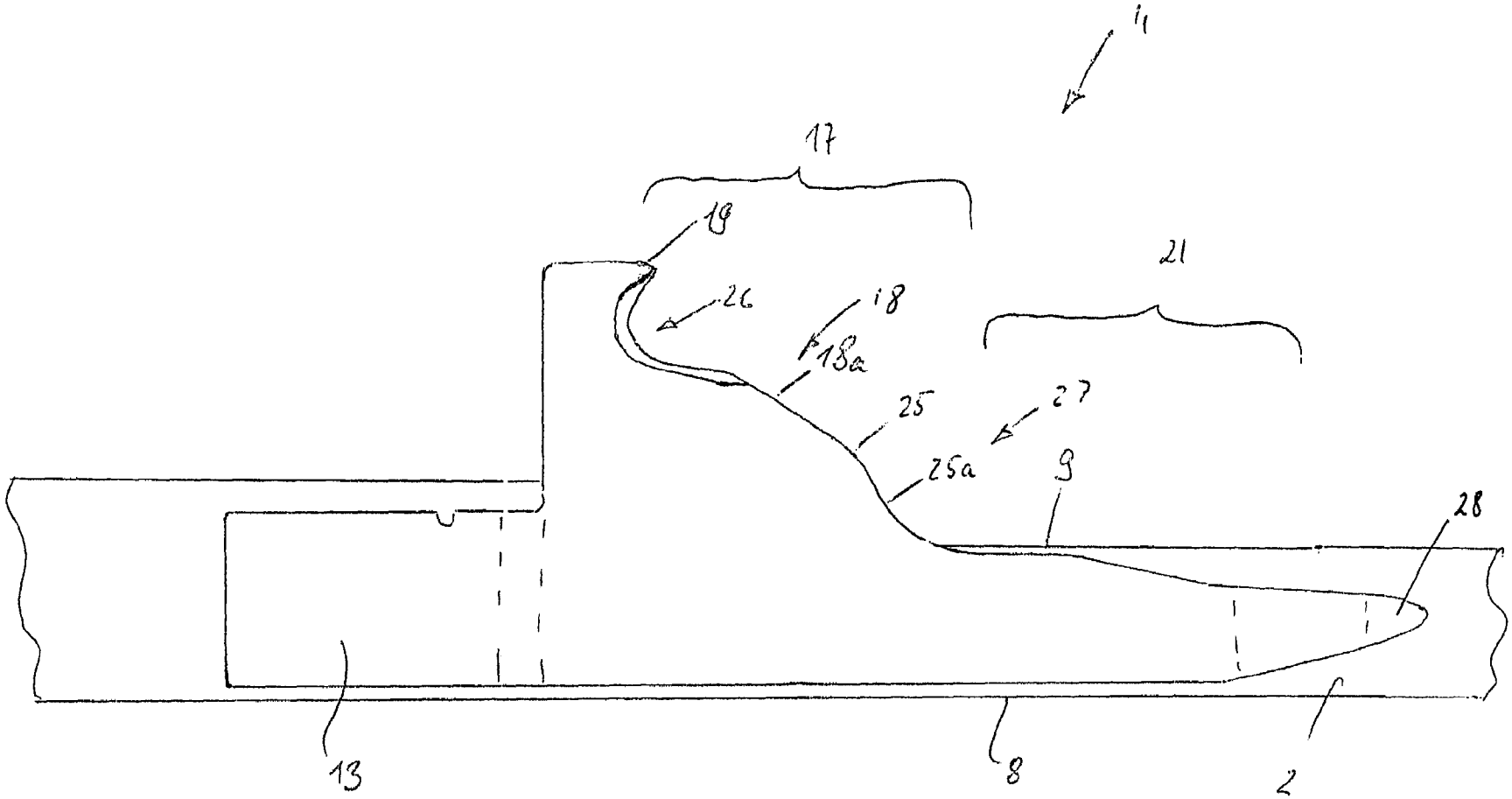
FIG. 5 is a side elevational view of a modified embodiment of the cutting needle similar to FIG. 2.

As illustrated in FIGS. 4 and 5, the loop support 27 and the cutting edge may have different lengths, inclinations and curvatures as required for effectively positioning the loops during a transfer step without the risk of accidentally cutting the loops, on the one hand, and for permitting a deliberate severance by outward overdriving the cutting needle 1, on the other hand. The edge portion 25*a* which constitutes the loop support 27, is oriented at a steeper inclination to the shank 2 than the remainder of the edge 18. As shown in FIG. 5, a portion 18*a* of the cutting edge 18 which joins the end 25 may be dull to securely exclude unintended cutting steps.

In its further course toward the upper corner 19 the cutting edge 18 may have an arcuate portion 26 for improving the cutting effect of the cutting portion 17.

While the lower edge of the knife element 11 is linear and extends essentially parallel to the needle back 8, the upper edge of the knife element 11 is formed, for example, by two edges which are oriented to one another at an obtuse angle and each of which defines an acute angle with the upper needle side 9. One of the two edges forms, at least along a portion thereof, the cutting edge 18. The linear upper edge of the transfer portion 21 and the linear upper edge of the cutting portion 17 abut one another approximately at the height of the upper needle side 9.

As seen in FIG. 6, the cutting portion 17 as well as the transfer portion 21 are formed of plate-like parts of the one-piece knife element 11. They are disposed in a common plane spaced from the flat side 7. The end 23 of the knife element 11 lies against the bottom of the recess 12 with a spring force. The end 23 may be forced away from the shank 2 against its resilient force.

Figure 7:
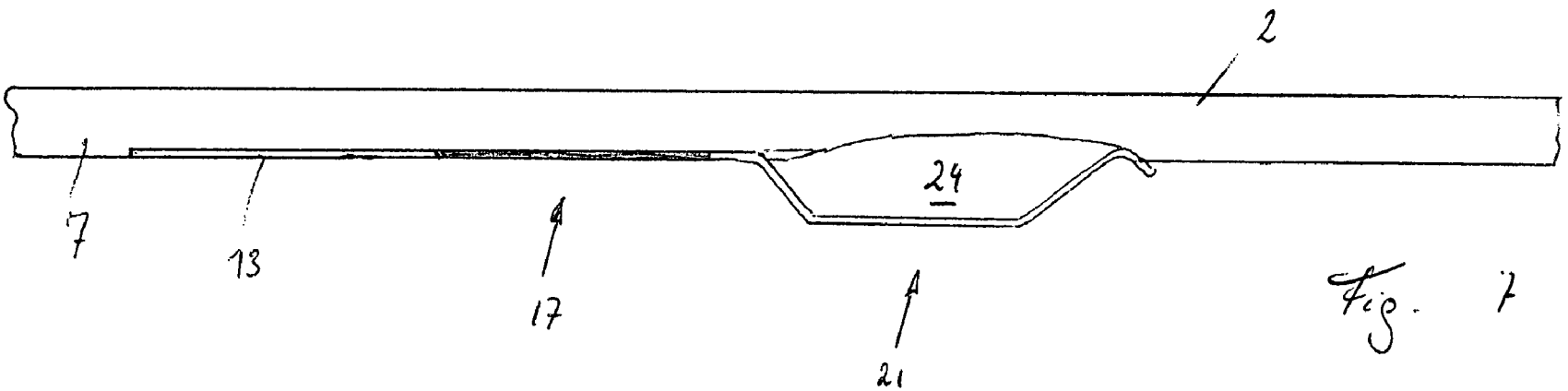
FIG. 7 is a top plan view of a modified embodiment of the cutting needle similar to FIG. 2, 3, 4 or 5.

FIG. 7 shows another modified embodiment of the cutting needle 1. To the extent that this embodiment corresponds to the previously described cutting needles, reference is made to the preceding description and the same reference characters. This embodiment departs from the previously described ones in that the cutting portion 17 and the transfer portion 21 are not arranged in a common plane; rather, they are situated in two planes which are arranged preferably parallel to one another. The penetration space 24 is thus formed exclusively in the region of the transfer portion 21, while the cutting portion 17, similarly to the cutting needle of FIG. 1, is essentially terminated by the flat side 7. The advantage of this embodiment resides in that the loops taken up by the cutting portion 17 are cut open essentially symmetrically.

By virtue of the distance present between the latch 4 when in its reverse position and the cutting edge 18, the cutting needle 1 may work as a conventional latch needle having an additional cutting function. The loops are cut open if the cutting needle 1 is driven out in the length direction L to such an extent that the loops contact the knife element 11 and run up on the cutting edge 18 away from the hook. In this manner the loops may be cut open or left uncut in a controlled manner.

Figure 8:
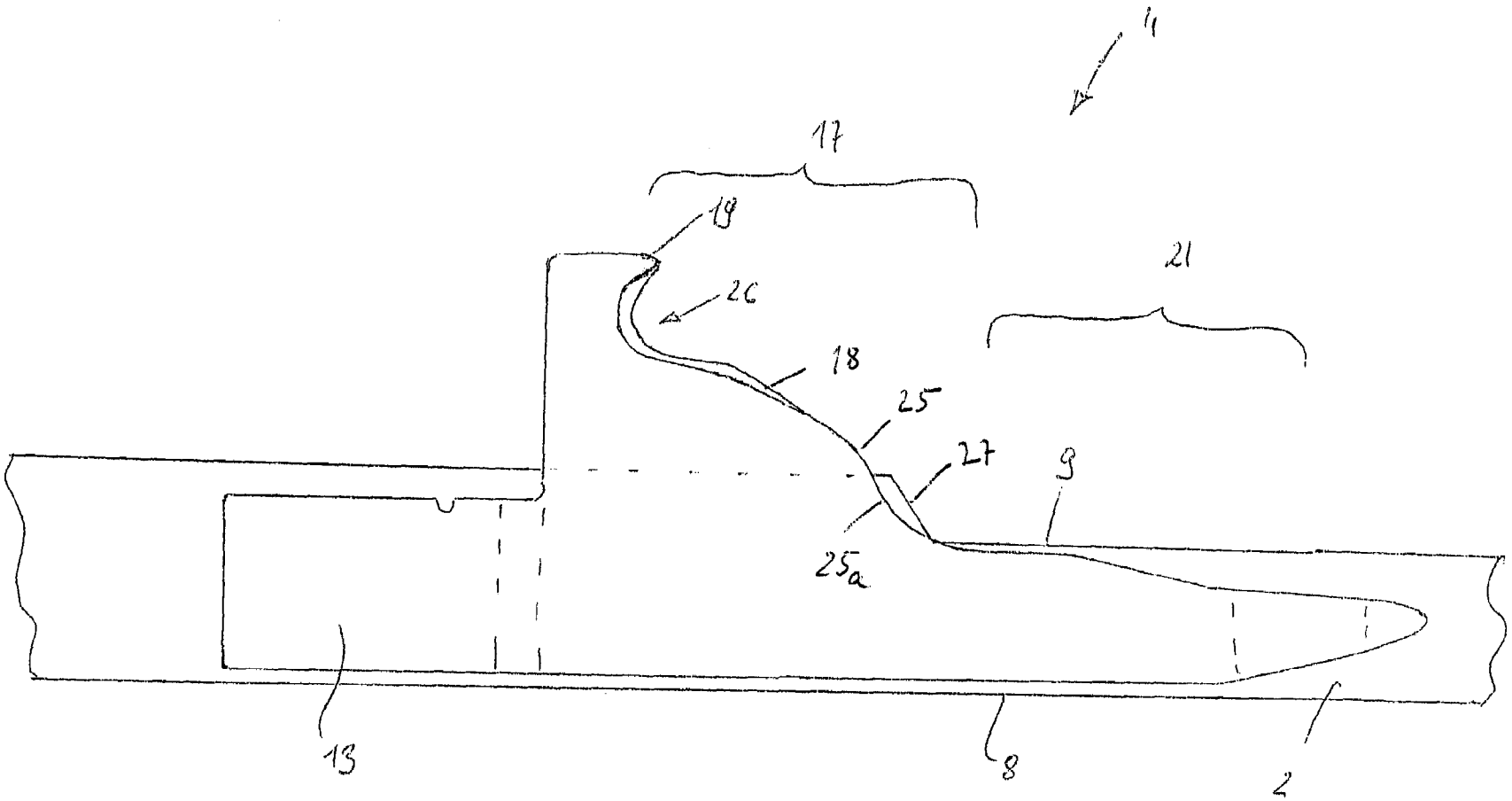
FIG. 8 is a side elevational view of a modified embodiment of the cutting needle having a loop support on the needle body.

As a modification of the embodiments described so far, the loop support 27 may be formed on the shank 2, as shown in FIG. 8. The part 25*a* of the upper edge of the knife element 11 trails the shoulder formed on the shank 2, so that a loop suspended from the shank 2 may run up on the shoulder. The shoulder is formed as a ramp or an S-shaped curve to permit the loop to slide over the shoulder and to arrive at the cutting edge 18, when the cutting needle 1 is overdriven outward.

Figure 9:
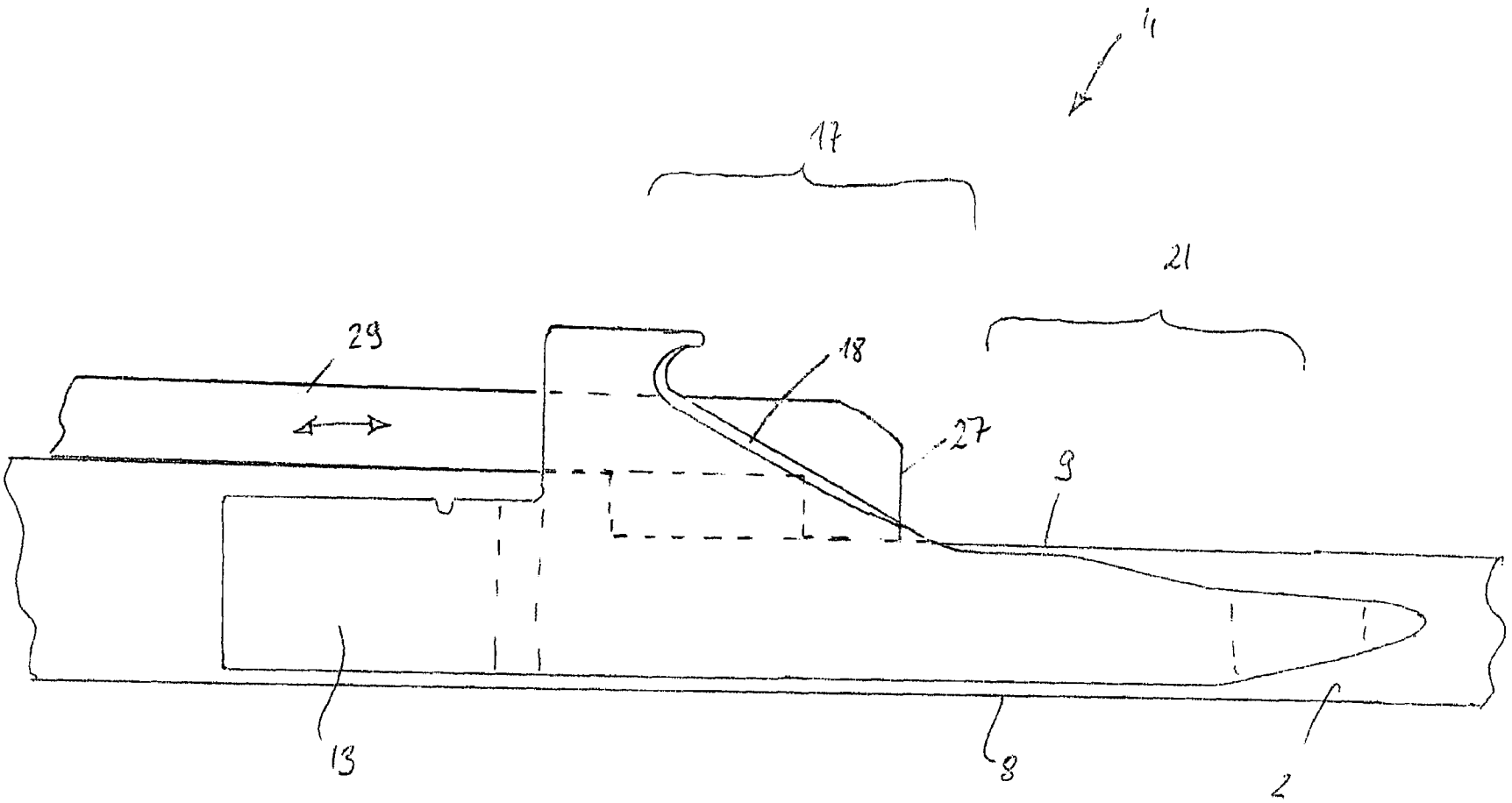
FIG. 9 is a side elevational view of a modified embodiment of the cutting needle having a movable loop support.

In accordance with the precedingly described embodiments of the cutting needle 1, the loop support 27, if present, is stationary. FIG. 9, on the other hand, shows a cutting needle 1 having a movable loop support 27. The latter is formed on a slider 29 which has at its end oriented toward the hook 3 a surface which is arranged approximately perpendicularly to the upper needle side 9. In an advance slider position the slider 29 covers the cutting edge, while in a withdrawn position the slider exposes the cutting edge. By an appropriate control of the slider position, possibly in connection with outward strokes of different magnitude of the cutting needle 1, the latter may function both as a transfer needle and as a cutting needle.

The embodiments of the cutting needle 1 according to FIGS. 2 to 8 have an expanded functionality. The needles, by virtue of the cutting element formed as a transfer spring, may be utilized as normal transfer needles. For example, the needles may be driven out to such an extent that the loops arrive on the transfer portion 21. The loops are not cut open there, but are taken up by needles which are guided perpendicularly to the cutting needle 1 into and through the penetration space 24. If, however, the loops are to be cut open, the cutting needle 1 is driven further beyond the transfer position, so that the loops arrive on the cutting portion 17. They are cut open not later than when they arrive at the portion 26. In this manner cut-out plush Jacquard patterns may be made with or without transfer steps.

The cutting needle 1 according to the invention is, for example, a latch needle and has a knife element 11 secured to the shank 2. The knife element 11 defines a cutting edge 18 which projects obliquely upward from the shank. The knife element 11 is arranged externally of the range of motion of the latch 4 and cuts open a loop situated on the shank when it is overdriven outward. The knife element 11 is made, for example, of a suitable spring steel and is held unremovably on the shank 2.

It will be appreciated that the above description of the present invention is susceptible to various modifications, changes and adaptations, and the same are intended to be comprehended within the meaning and range of equivalents of the appended claims.

LIST OF REFERENCE CHARACTERS

1 cutting needle
2 shank
3 hook
4 latch

5 pivot
6, 7 flat side
8 needle back
9 upper needle side
10 step, loop support
11 knife element
12 recess
13 securing portion
14 edge
15 recess
16 projection
17 cutting portion
18 cutting edge
18*a* part
19 corner
20 extension
21 transfer portion
22 location of bend
23 end region
24 penetration space
25 end
25*a* edge portion
26 portion
27 loop support
28 end
29 slider
30 end
L longitudinal direction
Q transverse direction

What is claimed is:

1. A cutting needle for loop-forming textile machines, comprising a shank provided at one end with a hook and, a separate knife element secured to the shank wherein the knife element has a cutting edge which is rising at an inclination relative to the longitudinal direction of the shank and is disposed in a recess formed in a side face of the shank, and further comprising a slider element mounted on the shank for movement in a longitudinal direction of the shank and having an edge facing the hook end of the shank that is approximately perpendicular to a top surface of the shank and which in a first position will effectively cover the cutting edge and in a second position will expose the cutting edge, whereby the needle can be selectively used as either a cutting needle or a transfer needle.

2. A cutting needle for loop-forming textile machines, comprising a shank provided at one end with a hook and, a separate knife element secured to the shank, and wherein the knife element is formed as a transfer spring that is secured in a recess formed on a side face of the shank, and has a cutting portion and a transfer portion spaced from the cutting portion in the longitudinal direction of the needle.

3. The cutting needle as defined in claim 2, wherein the knife element is resilient in a direction transverse to its cutting edge.

4. The culling needle as defined in claim 2, wherein the knife element is formed of a material that is different than the material of the shank.

5. The cutting needle as defined in claim 2, wherein the cutting portion and the transfer portion are disposed at a distance from the side face of the shank.

6. The cutting needle as defined in claim 5, wherein the cutting portion and the transfer portion are disposed in a common plane at a distance from the side face of the shank.

7. The culling needle as defined in claim 2, wherein the cutting portion is disposed in the recess on the side face of the shank while the transfer portion is laterally spaced from the side face of the shank.

* * * * *